US009902178B2

(12) United States Patent
Castells de Monet et al.

(10) Patent No.: US 9,902,178 B2
(45) Date of Patent: Feb. 27, 2018

(54) INDEXING PRINTHEAD

(71) Applicant: HEWLETT-PACKARD DEVELOPMENT COMPANY, L.P., Houston, TX (US)

(72) Inventors: Raimon Castells de Monet, Barcelona (ES); Alex Andrea Tallada, Barcelona (ES); David Claramunt Morera, Sant Esteve Sesrovires (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/324,651

(22) PCT Filed: Jul. 16, 2014

(86) PCT No.: PCT/EP2014/065265
§ 371 (c)(1),
(2) Date: Jan. 6, 2017

(87) PCT Pub. No.: WO2016/008520
PCT Pub. Date: Jan. 21, 2016

(65) Prior Publication Data
US 2017/0203591 A1 Jul. 20, 2017

(51) Int. Cl.
*B41J 25/00* (2006.01)
*B41J 23/00* (2006.01)

(52) U.S. Cl.
CPC ..... *B41J 25/001* (2013.01); *B41J 23/00* (2013.01)

(58) Field of Classification Search
CPC ..... B41J 25/001; B41J 23/00
See application file for complete search history.

(56) References Cited

U.S. PATENT DOCUMENTS

| | | | | |
|---|---|---|---|---|
| 6,345,879 | B1 * | 2/2002 | Fisher | B41J 2/145 347/20 |
| 6,478,403 | B1 | 11/2002 | Giles et al. | |
| 6,821,039 | B2 | 11/2004 | Lewis | |
| 7,052,102 | B2 | 5/2006 | Valero et al. | |
| 8,118,390 | B2 | 2/2012 | Pawlik | |
| 8,668,307 | B2 * | 3/2014 | Lewartowski | B41J 25/001 347/41 |
| 2002/0158144 | A1 | 10/2002 | Anderson et al. | |
| 2012/0281043 | A1 | 11/2012 | Hudd et al. | |

FOREIGN PATENT DOCUMENTS

| | | |
|---|---|---|
| EP | 0881820 | 12/1998 |
| EP | 2189289 | 5/2010 |
| EP | 2189292 | 11/2011 |

* cited by examiner

*Primary Examiner* — Thinh H Nguyen
(74) *Attorney, Agent, or Firm* — HP Inc. Patent Department

(57) ABSTRACT

A method in a printer comprising a first printhead to dispense a first printing fluid and a second printhead to dispense a second printing fluid, the first and second printheads being arranged on a common scan axis that is substantially perpendicular to a media advance direction. The method comprises controlling movement of the first and second printheads relative to a media being printed, between a first index position and a second index position, the second index position being downstream of the first index position, and wherein the movement occurs during a time period between a forward scan and a reverse scan of the first and second printheads across a media being printed.

20 Claims, 6 Drawing Sheets

INDEXING PRINTHEAD

A printer may dispense an additional printing fluid, for example a fixer agent and/or a binder fluid, in addition to another printing fluid, for example an ink, whereby the fixer agent and/or binder fluid and the ink are dispensed on the same area of a media.

Such systems allow broader ink design spaces, which can be used to improve different attributes, such as substrate compatibility, printout durability, color gamut or other attributes.

BRIEF DESCRIPTION OF THE DRAWINGS

For a better understanding of the examples described herein, and to show more clearly how the examples may be carried into effect, reference will now be made, by way of example only, to the following drawings in which.

DETAILED DESCRIPTION

Figure 1A:
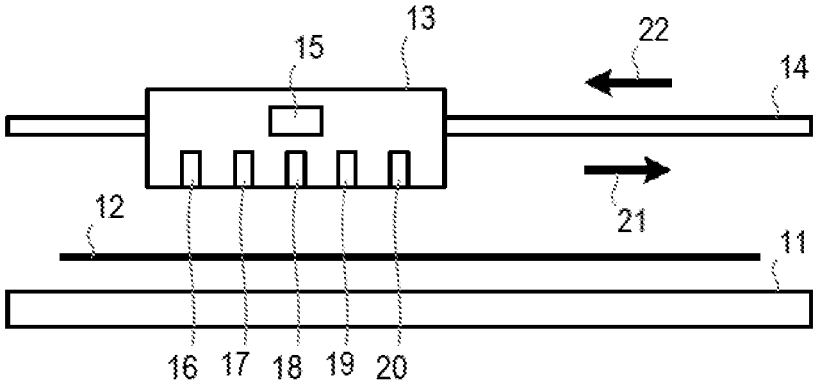
FIG. 1A shows a side view of an example printer apparatus.

As used herein, the term "ink" includes any form of printing fluid, including colored inks, such as Cyan, Magenta, Yellow and Black, CYMK, or white ink, or any other color ink, and also other liquids which are printed on a print media, such as liquids including biological specimens.

Ink jet printing is a printing process in which droplets of ink are deposited on a printing media, such as paper or textile, to form a desired image. The ink droplets, or recording fluid, are ejected from nozzles on a printhead in response to control signals.

An ink can be used with other printing fluids, for example a fixer fluid and/or a binder fluid. The fixer fluid may be jetted under and/or over an ink. A fixer fluid for pigment based inks may be designed, for example, to increase chroma and/or optical density. However, fixer fluids may also have other additional unspecified beneficial effects.

Fixer fluids may also further comprise an aqueous vehicle. Fixer fluids can also comprise additives such as surfactants or biocides or mixtures thereof. To minimize the liquid load on the substrate, fixer fluids may, for example, be formulated to be effective at volumes equal to or less than the volume of a colored ink being fixed. The drop volume of fixer fluids may, for example, be the same as the colored inks and thus, there may be no more than about one drop of fixer fluid for each drop of colored ink. Fixer fluids may be substantially colorless, for example, such that they do not perceptibly or substantially change the hue of a colored ink being fixed.

From the above it can be seen that a fixer fluid is thus a liquid applied to a print media to fix another liquid on the print media, e.g. to restrict the spreading of the other liquid though the print media from the location where the other liquid is originally applied. Thus, the fixer fluid can be regarded as a substance which may change the properties of the print media.

A binder fluid may also be used, for example, with an ink, or with an ink and a fixer fluid. A binder fluid, for example a varnish, may also have other additional unspecified beneficial effects.

The examples described herein relate to printing apparatus comprising a first printhead for depositing a first printing fluid and a second printhead for depositing a second printing fluid. The first printing fluid may comprise, for example, a fixer fluid or a binder fluid. The second printing fluid may comprise, for example, a colored ink or a white ink. Although the examples will be described in relation to first and second printing fluids, it is noted that the examples may also be used with additional printing fluids. It is noted that the printing apparatus may comprise additional other printheads, for example multiple color printheads, or additional fixer fluid printheads, or printheads for other purposes.

It is noted that the examples described herein are intended to be used with any type of fixer fluid or any type of ink. Some examples herein relate to the relative timing by which a first printing fluid (such as a fixer fluid) and a second printing fluid (such as an ink) are applied to a print media.

FIG. 1A shows an example of a printer apparatus comprising a printing carriage 13. The printing carriage may comprise a plurality of printheads, each printhead comprising a plurality of nozzles (not shown) for dispensing a fluid contained in a fluid supply that is integrated with the printhead or contained in a separate fluid supply. For example, FIG. 1A shows a printing carriage 13 comprising four color printheads 16, 17, 18 and 19 for dispensing colored inks, for example cyan, yellow, magenta and black (CYMK), and a printhead 20 for dispending a fixer fluid. The printing carriage 13 is controlled to move along a scan beam 14 in first and second directions to scan over a media 12 being printed. The first and second directions are referred to hereinafter as a forward scan illustrated by arrow 21 and a reverse scan illustrated by arrow 22. The forward scan 21 and reverse scan 22 are substantially perpendicular to a media advance direction 23 (as illustrated by the plan view of part of the printer apparatus in FIG. 1B). The media advance direction 23 corresponds to a direction in which the print media moves when being printed. Between forward and reverse scans, or after multiple scans in each direction, the print media 12 is advanced (for example over a fixed platen 11) in the media advance direction 23, as illustrated in the plan view of FIG. 1B. The arrow 24 refers to a media reverse direction, which will be referred to in the examples described later in the application.

Ink systems that use fixer fluids and/or binder fluids can allow "easier"' inks to be used in the printer apparatus. By "easier" it is meant that inks with lower content of solids can be used. However, a consequence of this is that more ink flux is needed to lay the same quantity of color pigments, compared to an equivalent type of ink system printer. Too much ink flux can result in pigments bleeding and coalescing.

One method to preserve image quality (IQ) is to limit the printing speed, to allow time for the evaporation of the vehicle carrying the fixer fluid (for example a solvent and/or water). The impact of limiting the printing speed may be a large factor, for example reducing the printing speed by half.

Another method of compensating for increased ink flux is to increase the drying power, to accelerate the evaporation of the fixer vehicle. However, because the timings are so short, high levels of energy are needed for the drying process if the printing speed is to be preserved.

If printheads of the different printing fluids are placed in-line a carriage, for example in-line in a printing carriage 13 as shown in FIG. 1A, then the time between the last dot of fixer and the first dot of ink (referred to herein as the ink-to-fixer time, I2F) is relatively short.

Figure 1B:
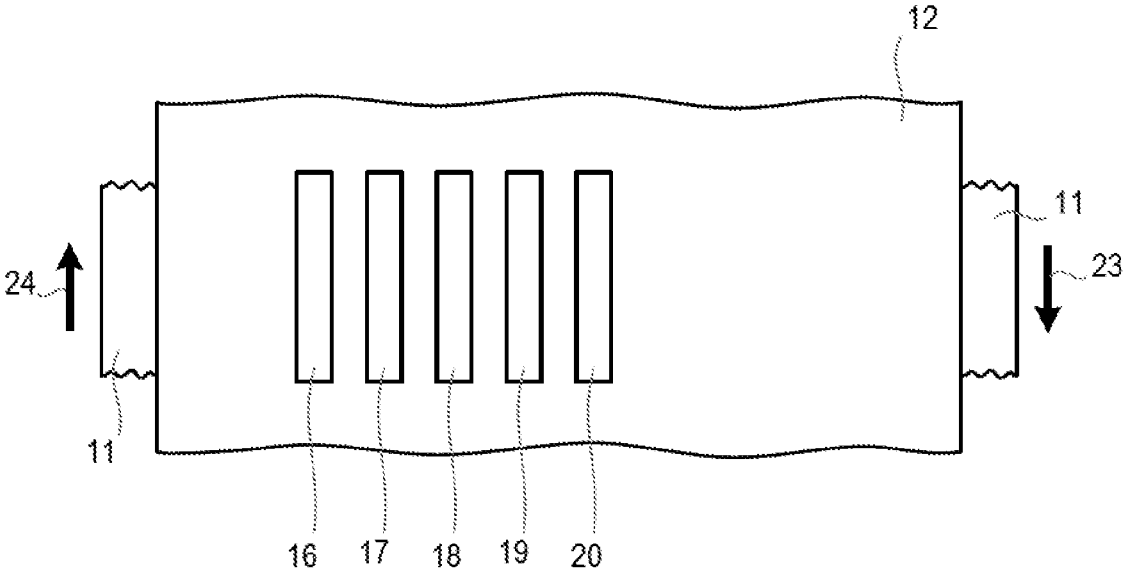
FIG. 1B shows a plan view of an example printer apparatus.

For example, if the fixer fluid and the ink are fired in the same scan or pass of the printheads over the media being printed, for example when moving in a single forward scan 21 (or in a single reverse scan 22) of FIGS. 1A and 1B, then the ink-to-fixer (I2F) time is then in the range of milli seconds. For example, if a printhead 20 for dispensing a fixer fluid and a printhead 19 for dispending an ink are placed one inch apart on a printing carriage 13, and the printing carriage 13 movies at sixty inches per second (60 ips) along the scan beam 14, then the ink-to-fixer time would be about 16 msec.

If the fixer fluid is fired in one direction of the pass, for example in a forward scan 21 of FIG. 1A, and the ink fired in a reverse scan 22 of FIG. 1A, then the ink-to-fixer time is increased to be in the range of 100's of msec. For example, in a 60 inch width printer a full swath of one printhead may take about 2.8 seconds, while an ink-to-fixer time may be about 300 ms.

The examples described hereinafter may, in some examples, provide increased ink-to-fixer time without substantially increasing swath time.

Figure 2:
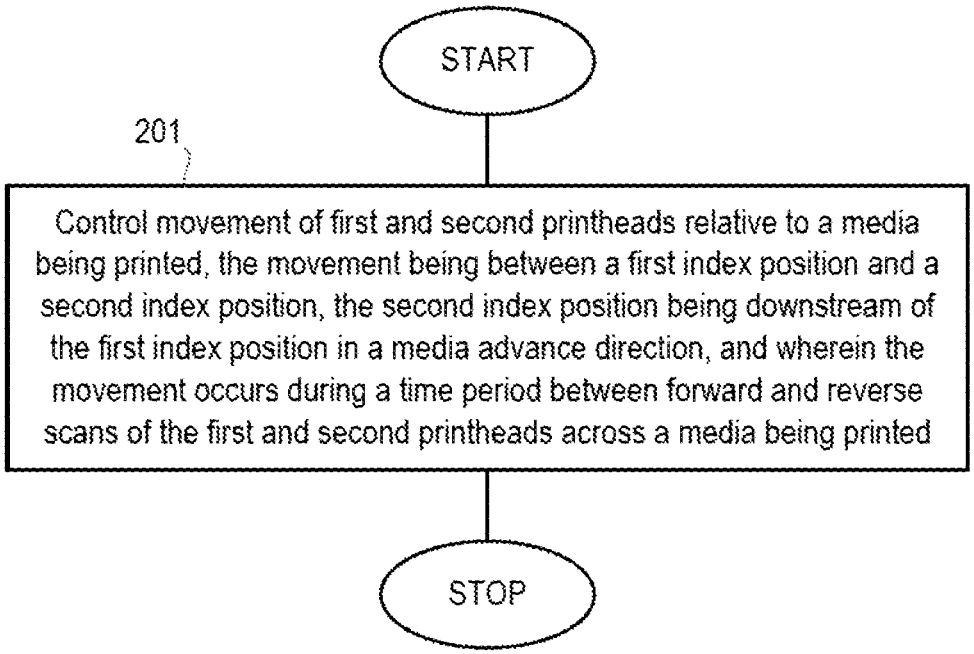
FIG. 2 shows a method according to an example.

Referring to FIG. 2, according to one example, there is provided a method in a printer comprising a first printhead to dispense a first printing fluid and a second printhead to dispense a second printing fluid, the first and second printheads being arranged on a common scan axis that is substantially perpendicular to a media advance direction. At 201, the method comprises controlling movement of the first and second printheads between a first index position and a second index position relative to a media being printed, the second index position being downstream of the first index position in a media advance direction, and wherein the movement occurs during a time period between a forward scan and a reverse scan of the first and second printheads across a media being printed. The first printing fluid may comprise, for example, a fixer fluid. The second printing fluid may comprise, for example, an ink.

This may, in some examples, enable the time between dispensing the first printing fluid and second printing fluid over the same portion of media to be increased, as will be explained in further detail in the example below.

FIGS. 3A to 3D illustrate in further detail an example for printing a first printing fluid by a first printhead and a second printing fluid by a second printhead, where the first and second printheads are arranged on a common scan axis (for example in-line in a printing carriage), and wherein the first and second printheads are moveable between a first index position and a second index position relative to a media being printed, the second index position being downstream of the first index position in a media advance direction. As such, the first and second printheads can be controlled to move, relative to the media, back and forth in a media advance direction and a media reverse direction, as well as in the directions of forward and reverse scans.

In FIGS. 3A to 3D, movement in the direction of a forward scan 21 or movement in the direction of a reverse scan 22 is shown on a Y-axis, while movement in a media advance direction 23 (or in the opposite media reverse direction 24) are shown on an X-axis.

Figures 3A, 3B, 3C:
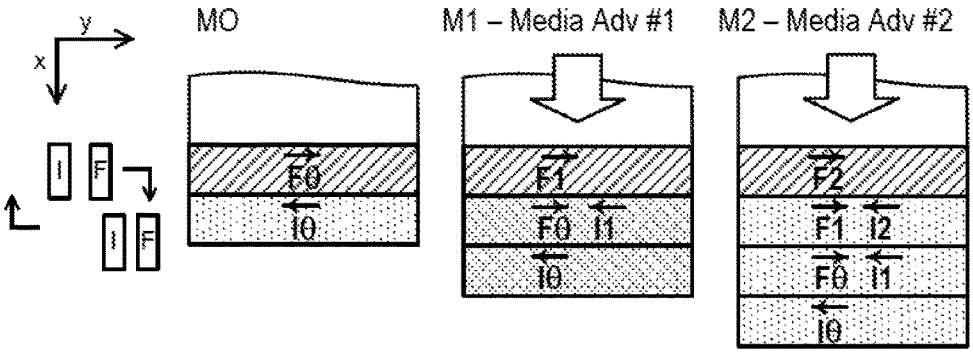
FIGS. 3A to 3D illustrate in further detail example firing and timing diagrams of an example printer apparatus.

Referring to FIG. 3A, when the media is in a first media advance position M0, a first printing fluid (for example a fixer fluid F0) and a second printing fluid (for example an ink I0) are dispensed as follows.

Figure 3D:
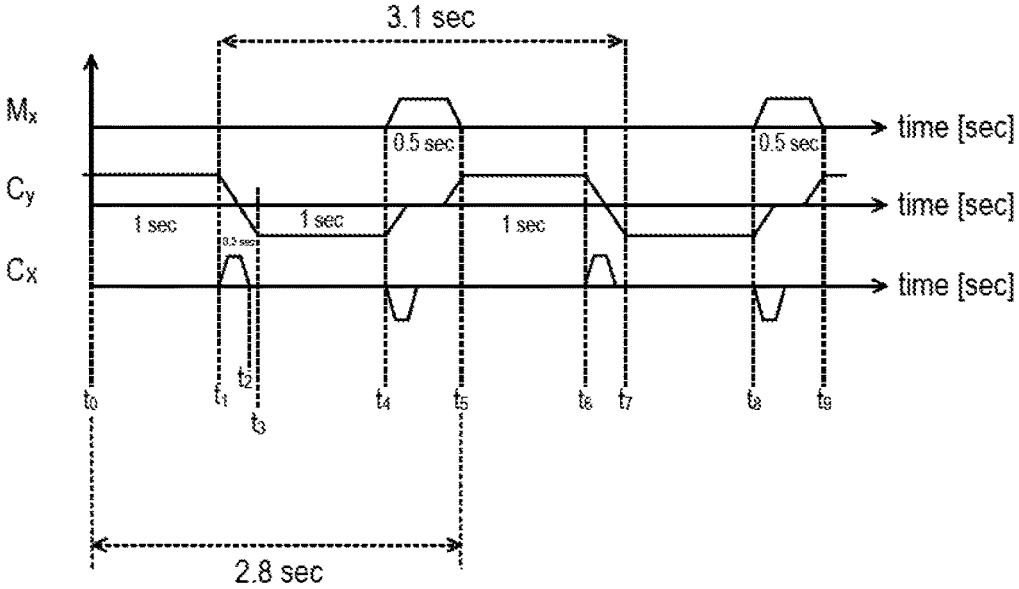

As illustrated in FIG. 3D, between time $t_0$ and time $t_1$ the media is a first media position, M0, and the printer carriage makes a first pass in a first printhead direction, i.e. a forward scan. During the forward scan (represented by the arrow pointing to the right in FIG. 3A) a fixer fluid F0 is fired in a current row (Row 0) or pass of the media. It is noted that the width or area of the fixer fluid being deposited may depend on the type of printhead being used, and the configuration of the printer.

The carriage decelerates to a stop and begins to accelerate in the opposite direction, i.e. decelerate from the forward scan and accelerate into a reverse scan, between times $t_1$ and $t_3$.

Between times $t_3$ and $t_4$ the printing carriage makes a reverse scan while the media is still in the first media position M0. During the reverse scan an ink I0 is dispensed or fired. As before, the width or area of ink may depend on the type of printhead being used, and the configuration of the printer.

However, the ink is not fired over the same row or area (Row 0), but in a previous row (Row −1), that is, an area downstream of the area in which the fixer F0 was, just fired.

It can be seen from FIG. 3D that, between the forward scan and the reverse scan, the first and second printheads are controlled to move from a first index position to a second index position relative to the media being printed, illustrated by the control signal $C_X$ between times $t_1$ and $t_2$. According to an example the indexing movement comprises moving the printheads (which as noted earlier are commonly aligned on a scan axis) in a media advance direction, i.e. downstream relative to the media. As such, the printheads will effectively lie over a previous row (Row −1) of the media, which will be explained later with reference to FIGS. 4A to 4D. It is noted that this procedure or movement of the printheads may occur at any time between times $t_1$ and $t_3$, i.e. at any point during the time period between scans.

Between times $t_4$ and $t_5$ the media is advanced in a media advance direction to a second media position M1. Also during this time the printing carriage decelerates from the reverse scan to a standstill, waits for the media to advance, and then starts to accelerate into the next forward scan. The first and second printheads also perform an indexing movement in a media reverse direction, i.e. from the second index position back to the first index position, during this period, as shown by the control signal $C_X$. It is noted that this procedure or movement may be performed or occur at any time between times $t_4$ and, $t_5$, i.e. at any point during the time period between scans.

Between times $t_5$ and $t_6$ the printing carriage makes a subsequent forward scan. During this forward scan a fixer fluid F1 is deposited or fired, as shown in FIG. 3B.

The carriage decelerates to a stop and begins to accelerate in the opposite direction, i.e. decelerate from the forward scan and accelerate into a subsequent reverse scan, between times $t_6$ and $t_7$.

Between times $t_7$ and $t_8$ the printing carriage makes a reverse scan while the media is still in the second media position M1. During the reverse scan an ink I1 is dispensed or fired.

However, the ink is not fired over the same row or area as the fixer fluid F1 but in a previous row relative to where the fixer fluid F1 was just dispensed (that is, an area downstream of the area in which the fixer F1 was just fired). This corresponds to a row or area in which the fixer fluid F0 was previously fired (as shown in FIG. 3B, and as will be explained in greater detail in FIGS. 4A to 4D).

It can be seen from FIG. 3D that, between the forward scan (of time $t_5/t_6$) and the reverse scan (of time $t_7/t_8$), the first and second printheads are controlled to move from a first index position to a second index position, illustrated by the control signal $C_X$ which occurs during the time period between times $t_6$ and $t_7$. According to an example the indexing movement comprises moving the printheads (which as noted earlier are commonly aligned on a scan axis) in a media advance direction, i.e. downstream relative to the media. As such, the printheads will effectively, lie over a previous row of the media.

Between times $t_8$ and $t_9$ the media is advanced in a media advance direction to a third media position M2. Also during this time the printing carriage decelerates from the reverse scan to a standstill, waits for the media to advance, and then starts to accelerate into the next forward scan. The first and second printheads also perform an indexing movement in a media reverse direction, i.e. from the second index position back to the first index position during this period, as shown by the control signal $C_X$. It is noted that this procedure may be performed at any time between times $t_8$ and $t_9$.

From the above it can be seen that from the last drop of fixer fluid at the end of the first forward scan, i.e. substantially just before or at $t_1$, the next occurrence of a first drop of ink over the same area of media will be when the first drop of ink is deposited soon after or at time $t_7$, i.e. when the ink I1 is deposited in that reverse scan between times $t_7$ and $t_8$. Therefore, in this example the ink-to fixer time has been increased to about 3.1 seconds (for example as shown between times $t_1$ to $t_7$). However, the swath time remains about the same, for example 2.8 seconds in the example of FIG. 3D, e.g. between $t_0$ and $t_5$.

The increase in ink-to-fixer time will be explained further in relation to FIGS. 4A to 4D, which explain how the fixer fluids and inks of the example of FIGS. 3A to 3D may be fired.

Figure 4A:
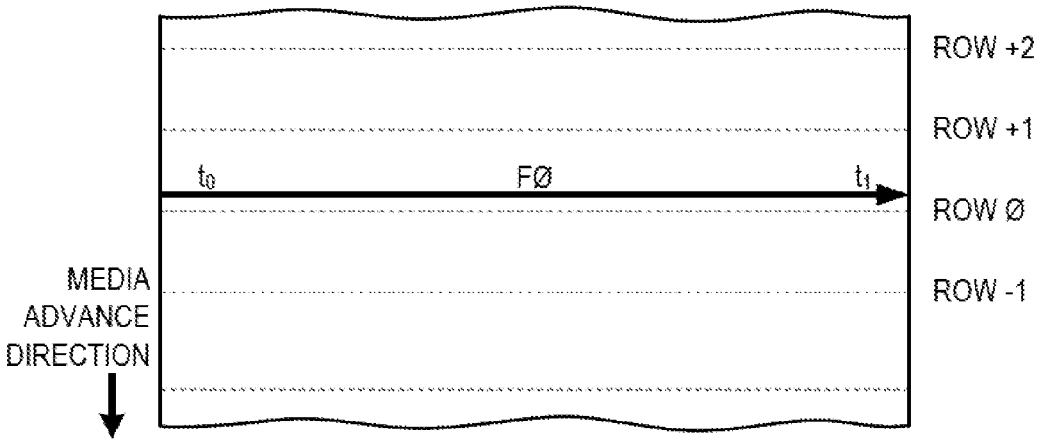
FIGS. 4A to 4D illustrate in further detail an example of printing fluids being deposited.

FIG. 4A shows a fixer fluid F0 being fired between times $t_0$ and $t_1$ in a forward scan. It is assumed for illustrative purposes that this fixer fluid is deposited in an area or row of the media referenced ROW 0. It is noted that the width or area of the fixer fluid being deposited may depend on the type of printhead being used, and the configuration of the printer.

Figure 4B:
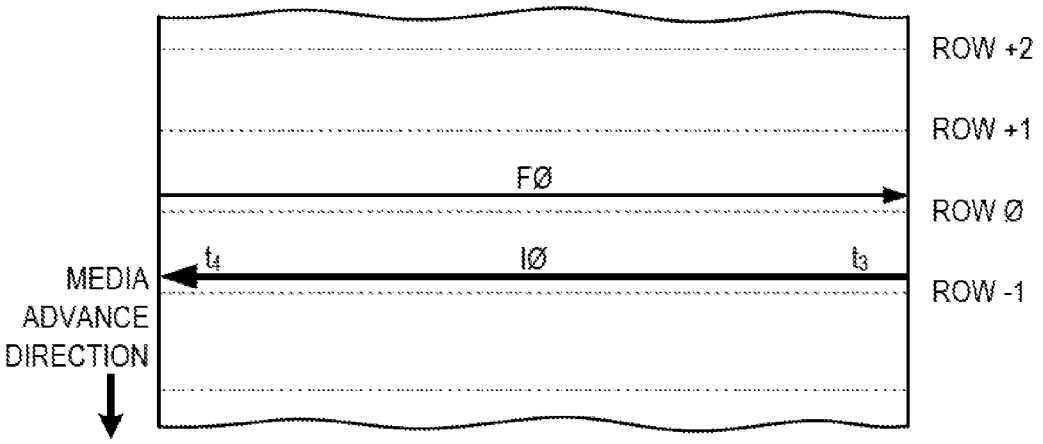

Referring to FIG. 4B, because of the indexing movement of the printheads relative to the media during time period $t_1$ to $t_2$, i.e. from a first index position to a second index position, it can be seen that the ink I0 is fired in a downstream or previous row, ROW −1, in the reverse scan between times $t_3$ to $t_4$. As such, the ink I0 is not deposited over the fixer fluid F0 which has just been dispensed.

Figure 4C:
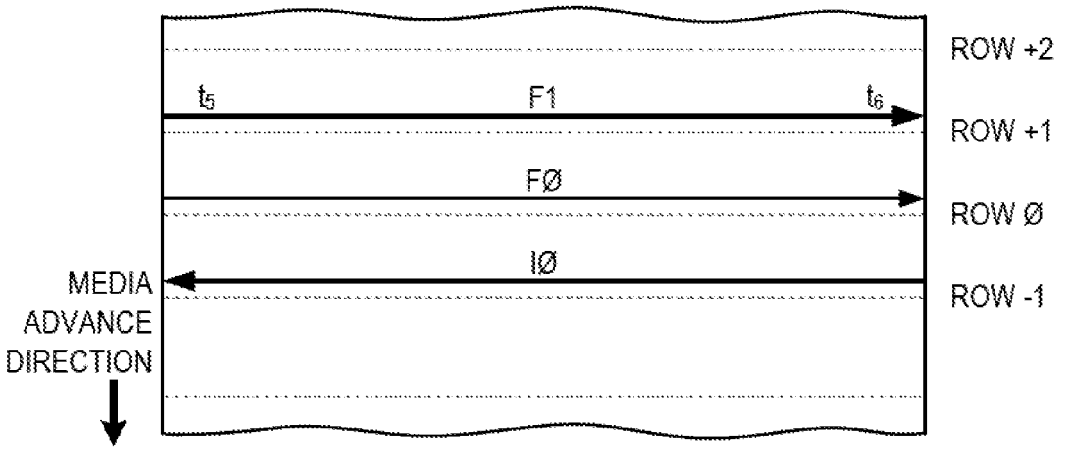

Referring to FIG. 4C, because of the indexing movement of the printheads relative to the media during time period $t_4$ to $t_5$, i.e. back from the second index position to the first index position, and also because of the advance of the media from the first media position M0 to the second media position M1, in FIG. 4C the fixer fluid F1 is fired between times $t_5$ and $t_6$ in a forward scan in an area or row of the media referenced ROW +1. As such, the fixer fluid F1 is not deposited over the ink I0 which has just been dispensed.

Figure 4D:
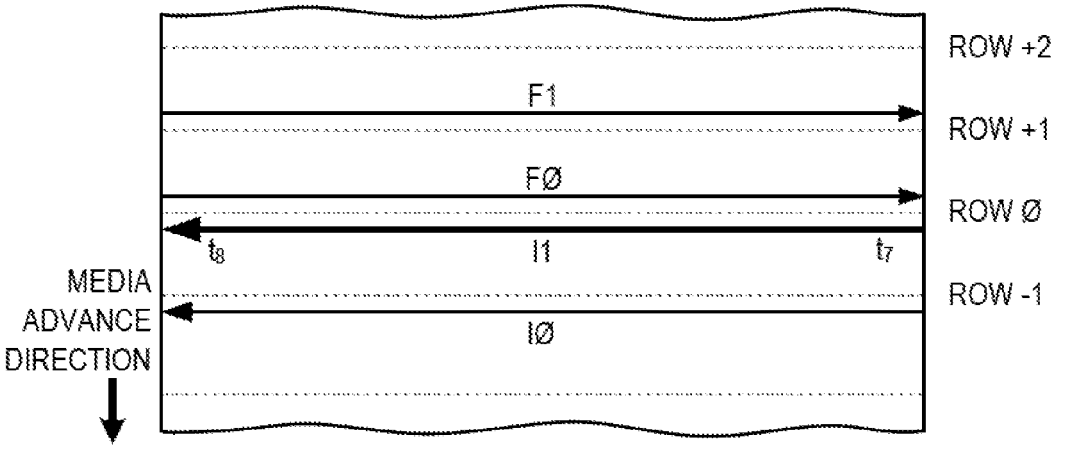

Referring to FIG. 4D, because of the indexing movement of the printheads relative to the media during time period $t_6$ to $t_7$, i.e. from a first index position to a second index position, it can be seen that the ink I1 is fired in a downstream or previous row compared to ROW +1 in the reverse scan between times $t_7$ to $t_8$, i.e. in ROW 0. As such, the start of this reverse scan at time $t_7$ is the first occurrence of ink (i.e. ink I1) being deposited over an area of the media where fixer fluid (F0) has previously been fired.

The example described above in relation to FIGS. 3A to 3D and 4A to 4D therefore provides a method in a printer comprising a first printhead to dispense a first printing fluid (for example a fixer fluid) and a second printhead to dispense a second printing fluid (for example an ink), the first and second printheads being arranged on a common scan axis that is substantially perpendicular to a media advance direction. The method comprises controlling movement of the first and second printheads between a first index position and a second index position relative to a media being printed, the second index position being downstream of the first index position in a media advance direction, and wherein the movement occurs during a time period between a forward scan and a reverse scan of the first and second printheads across a media being printed.

The method may comprise controlling the first printhead to fire the first printing fluid during at least a portion of the forward scan across the media being printed, moving the first and second printheads, relative to a media being printed, from the first index position to the second index position, and controlling the second printhead to fire the second printing fluid during at least a portion of the reverse scan across the media being printed.

The method may further comprise moving the first and second printheads from the second index position to the first index position, and advancing the media in the media advance direction, prior to a subsequent forward scan of the first and second printheads.

In the examples described above various methods may be provided for enabling the indexing movement.

With regard to the indexing movement of the first and second printheads, in an example the indexing movement involves the media being stationary while the forward and reverse scans are being performed, such that movement of the first and second printheads from the first index position to the second index position comprises physically moving the first and second printheads relative to a chassis of the printer apparatus.

In an example where the first and second printheads are provided in a carriage, with the carriage coupled to a scan beam for performing the forward and reverse scans, the movement of the first and second printheads between the first index position and the second index position may comprise moving the carriage relative to the scan beam.

In an example where the first and second printheads are provided in a carriage, with the carriage coupled to a scan beam for performing the forward and reverse scans, the movement of the first and second printheads between the first index position and the second index position may comprise moving the scan beam relative to a printer chassis. In such an example the carriage may remain in a fixed positional relationship with the scan beam in a media advance or media reverse direction, with the scan beam itself being used to control movement of the first and second printheads between the first and second index positions. The scan beam may be controlled to allow movement in directions towards and away from the print media (e.g. to allow for different height or thicknesses of print media), and in the upstream and downstream directions to enable movement between the first and second index positions.

In another example, movement between the first and second index positions may comprise a combination of movement by the carriage relative to the scan beam, and movement of the scan beam itself relative to a chassis of the printer.

In another example, instead of providing the indexing movement by physically moving the first and second printheads, the movement of the first and second printheads from the first index position to the second index position relative to a media may comprise movement of the media in a media reverse direction, with the printheads remaining stationary.

This alternative example involves the media being moved in reverse or upstream rather than the printheads being moved downstream or in the media advance direction.

The examples described herein provide a method and apparatus to defer the deposition of a first printing fluid over a second printing fluid, for example a color ink on top of a fixer dot, and thus reduce the effects of higher ink flux. This is because it provides the necessary time for the fixer vehicle to evaporate and avoid it bleeding and coalescing with the color dot.

Figure 5:
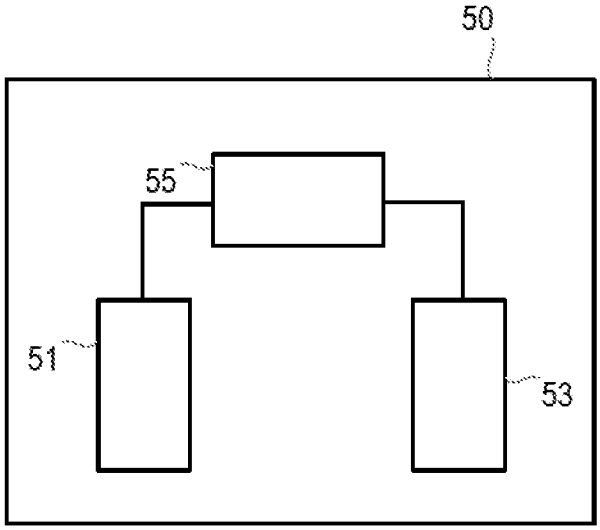
FIG. 5 shows an example of a printer apparatus.

Referring to FIG. 5, according to, another example a printer 50 comprises a first printhead 51 to dispense a first printing fluid and a second printhead 53 to dispense a second printing fluid. The first and second printheads 51, 53 are arranged on a common scan axis (not shown) that is substantially perpendicular to a media advance direction. A controller 55 controls movement of the first and second printheads relative to a media being printed, the movement being between a first index position and a second index position, the second index position being downstream of the first index position in a media advance direction, and wherein movement occurs between forward and reverse scans of the first and second printheads across a media being printed, to increase the time between dispensing the first printing fluid and second printing fluid over the same portion of media.

The controller 55 may control the first printhead 51 to fire the first printing fluid during at least a portion of the forward scan across the media being printed, and control the second printhead 53 to fire the second printing fluid during at least a portion of the reverse scan across the media being printed, wherein the forward and reverse scans are performed while the media is stationary. The controller 55 may further control movement of the first and second printheads 51, 53 from the first index position to the second index position between the forward and reverse scans, and while the media is stationary.

Prior to a subsequent forward scan of the first and second printheads, the controller 55 may control movement of the first and second printheads 51, 53 from the second index position to the first index position, and advance the media in a media advance direction.

In an example, the printer 50 may comprise a carriage (not shown) for mounting the first and second printheads, and a scan beam (not shown) for mounting the carriage, the carriage being moveable during use along the scan beam to perform the forward and reverse scans. The carriage may be moveable relative to the scan beam in a media advance direction, to enable movement of the first and second printheads between the first index position and the second index position.

In an example, the printer 50 may comprise a carriage (not shown) for mounting the first and second printheads, and a scan beam (not shown) for mounting the carriage, the carriage being moveable during use along the scan beam to perform the forward and reverse scans. The scan beam may be moveable relative to a printer chassis in a media advance direction, to enable movement of the first and second printheads between the first index position and the second index position.

In an example the printer 50 comprises a reversing mechanism to move a media in a media reverse direction, to provide the effective movement of the first and second printheads from the first index position to the second index position relative to a media being printed.

The examples may be based on a printhead carriage that has an effective indexing movement in the axis perpendicular to the printing (i.e. the indexing movement being in the same axis as the media advance direction).

This may, for example, increase ink-to-fixer time without substantially increasing swath time and by using efficient and cost-effective designs. By comparison, increasing the ink-to-fixer time by physically staggering a fixer printhead and an ink printhead in different rows of a printing carriage may cause the resulting printer to be significantly larger (in size) and more expensive. For example, the carriage can double in size and weight, which also requires a larger structure to hold the carriage and preserve the pen-to-paper space (normally a staggered carriage cannot be held in a cantilever, and so a second scan beam is provided). Having staggered ink and fixer printheads also implies larger impelling systems (for example motors, belts, friction bushings or bearings). Larger printhead service station modules are also needed (having capping stations, wiping stations and so forth). Furthermore, physically staggering the printheads in different rows results in the swath time being changed (for example being about 1.5 seconds compared to about 2.8 seconds in the example of FIGS. 3A to 3D, while the ink-to-fixer time only increases to about 0.5 seconds, compared to the 3.1 seconds of the example of FIGS. 3A to 3D).

The printheads of the first printing fluid and second printing fluid, for example printheads of the color inks and the fixer liquids, of the examples described herein are in-line, but mounted on a carriage that has an indexing movement in the axis perpendicular to the printing (same axis as substrate advance).

As illustrated in the example of FIGS. 3A to 3D, a full swath of one printhead takes about 2.8 seconds (i.e. about the same time as some of the other non-staggered examples), but the ink-to-fixer time is about 3.1 seconds, an order of magnitude above that of the other configurations.

The examples described herein may, in some examples, enable printing systems employing inks and/or fixer fluids and/or binder fluids and/or white ink, or other printing fluids, to be provided, while preserving similar printer cost as with other inks. The examples may, in some examples, also avoid the cost penalty of using a staggered printhead carriage. The examples also may, in some examples, avoid the use of complex drying mechanisms in the printzone (which is a crowded zone, with many restrictions), and minimize cross-contamination between the first printing fluid and the second printing fluid, for example the fixer and the ink, by firing them separately.

Although the examples above have been described in terms of a fixer fluid being deposited prior to a corresponding ink fluid, it is noted that the examples may also be used in applications where the reverse procedure is applied, i.e. the ink fluid jetted prior to the fixer fluid. The examples may also be used where other first and second printing fluids are deposited over a common area of media, including first and second printing fluids which are the same.

It is noted that the amount by which the printheads move between the first index position and the second index position (either through physical movement of the printheads or movement of the media) depends on a particular application. For example, this distance can depend on the width of the printheads being used, the number of passes or scans that a printer is configured to perform for a given area of print (for example single pass or multi-pass), and other factors.

It is also noted that, although the examples refer to first and second index positions, a printer may be configured to provide more that first and second index positions in the media advance direction, thereby enabling more control options to be provided, for example enabling the ink-to-fixer time to be increased even further.

According to another example, a printer comprises a common scan axis to mount a first fluid printhead (for example a printing fluid printhead) and a second fluid printing (for example a fixer fluid printhead), the common scan axis being substantially perpendicular to a media advance direction, wherein the first fluid printhead and the second fluid printhead are moveable along the scan axis and in an upstream direction and a downstream direction.

According to another example, a printer comprises a common scan axis to mount a first fluid printhead (for example a printing fluid printhead) and a second fluid printhead (for example a fixer fluid printhead), the common scan axis being substantially perpendicular to a media advance direction, wherein the first fluid printhead and the second fluid printhead are moveable along the common scan axis and along an axis parallel to the media advance direction.

According to another example, printer comprises a common scan axis to mount a first fluid printhead (for example a printing fluid printhead) and a second fluid printhead (for example a fixer fluid printhead), the common scan axis being substantially perpendicular to a media advance direction. The printer comprises a controller that, between depositing a first printing fluid and a second printing fluid over the same row across the width of a media being printed, controls the printer to deposit a printing fluid in a different row, or printing fluid in multiple different rows.

According to another example, there is provided a method in a printer comprising a first printhead and a second printhead commonly aligned on a scan axis, the scan axis being substantially perpendicular to a media advance direction. The method comprises (a) controlling the first printhead to fire a first printing fluid during at least a portion of a first scan across a media being printed, and controlling the second printhead to fire a second printing fluid during at least a portion of a reverse scan across the media being printed, wherein the forward and reverse scans are performed while the media is stationary in a first position along a media advance path; (b) moving the first and second printheads in a media advance direction from a first index position to a second index position along the media advance path, wherein the first and second printheads are moved between the forward and reverse scans while the media is stationary; and (c) prior to a subsequent scan in the forward direction, moving the first and second printheads in a media reverse direction from the second index position to the first index position, and moving the media in a media advance direction; and (d) repeating steps (a) to (c).

Although the examples have been described in relation to the depositing of a fixer fluid as the first printing fluid, and in relation to an ink as the second printing fluid, it is noted that any combination of first and second printing fluids may be used in the examples, for example a binder fluid and an ink, or a fixer fluid and a binder fluid, or fixer fluid and an ink, or any other combination of fluids. It is also noted that the techniques can be used with additional printing fluids, for example a fixer fluid as a first printing fluid, an ink as a second printing fluid, and a binder fluid as a third printing fluid.

It is noted that although the examples described herein refer to a forward scan being in a particular direction with respect to the media advance direction, and the reverse scan being in the opposite direction, the directions of the forward and reverse scans may be reversed, such that a forward scan is provided in the direction of arrow 22 in FIG. 1A, and a reverse scan in the direction of arrow 21 in FIG. 1A.

It should be noted that the above-mentioned examples illustrate rather than limit the invention, and that those skilled in the art will be able to design many alternative examples without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. A method in a printer comprising a first printhead to dispense a first printing fluid and a second printhead to dispense a second printing fluid, the first and second printheads being arranged on a common scan axis that is substantially perpendicular to a media advance direction, the method comprising:

controlling movement of the first and second printheads relative to a media being printed, the movement being between a first index position and a second index position, the second index position being downstream of the first index position in a media advance direction, and wherein the movement occurs during a time period between a forward scan and a reverse scan of the first and second printheads across a media being printed.

2. The method of claim 1, comprising:

controlling the first printhead to fire the first printing fluid during at least a portion of the forward scan across the media being printed;

moving the first and second printheads, relative to a media being printed, from the first index position to the second index position; and controlling the second printhead to fire the second printing fluid during at least a portion of the reverse scan across the media being printed.

3. The method of claim 2, comprising moving the first and second printheads from the second index position to the first index position, and advancing the media in the media advance direction, prior to a subsequent forward scan of the first and second printheads.

4. The method of claim 1, wherein the first and second printheads are provided in a carriage, the carriage coupled to a scan beam to perform the forward and reverse scans, and wherein movement of the first and second printheads between the first index position and the second index position comprises moving the carriage relative to the scan beam.

5. The method of claim 1, wherein the first and second printheads are provided in a carriage, the carriage coupled to a scan beam to perform the forward and reverse scans, and wherein movement of the first and second printheads between the first index position and the second index position comprises moving the scan beam relative to a printer chassis.

6. The method of claim 1, wherein the media is stationary while the forward and reverse scans are being performed, such that movement of the first and second printheads from the first index position to the second index position comprises physically moving the first and second printheads relative to a chassis of the printer apparatus.

7. The method of claim 1, wherein movement of the first and second printheads from the first index position to the second index position comprises movement of the media in a media reverse direction.

8. The method of claim 1, wherein the first printing fluid and the second printing fluid comprise any combination of a fixer fluid, a binder fluid, a colored ink, or a white ink.

9. A printer comprising:

a first printhead to dispense a first printing fluid;

a second printhead to dispense a second printing fluid, the first and second printheads being arranged on a common scan axis that is substantially perpendicular to a media advance direction; and a controller to control movement of the first and second printheads relative to a media being printed, the movement being between a first index position and a second index position, the second index position being downstream of the first index position in a media advance direction, and wherein the movement occurs during a time period between forward and reverse scans of the first and second printheads across a media being printed, to increase the time between dispensing the first printing fluid and second printing fluid over the same portion of media, wherein the first printhead only deposits the first printing fluid during the forward scan and the second printhead only deposits the second printing fluid during the reverse scan.

10. The printer of claim 9, wherein the controller controls the first printhead to fire the first printing fluid during at least a portion of the forward scan across the media being printed, and controls the second printhead to fire the second printing fluid during at least a portion of the reverse scan across the media being printed, wherein the forward and reverse scans are performed while the media is stationary, the controller further controlling movement of the first and second printheads from the first index position to the second index position between the forward and reverse scans, and while the media is stationary.

11. The printer of claim 10, wherein prior to a subsequent forward scan of the first and second printheads, the controller controls movement of the first and second printheads from the second index position to the first index position, and advances the media in the media advance direction.

12. The printer of claim 9 comprising:

a carriage to mount the first and second printheads;

a scan beam to mount the carriage, the carriage being moveable during use along the scan beam to perform the forward and reverse scans;

wherein the carriage is moveable relative to the scan beam in a media advance direction, to enable movement of the first and second printheads between the first index position and the second index position.

13. The printer of claim 9 comprising:

a carriage to mount the first and second printheads;

a scan beam to mount the carriage, the carriage being moveable during use along the scan beam to perform the forward and reverse scans;

wherein the scan beam is moveable relative to a printer chassis in a media advance direction, to enable movement of the first and second printheads between the first index position and the second index position.

14. The printer of claim 9, comprising a reversing mechanism to move a media in a media reverse direction, to provide movement of the first and second printheads from the first index position to the second index position relative to a media being printed.

15. The printhead of claim 9, wherein the time between dispensing the first printing fluid and the second printing to a common point on the substrate is greater than a time to scan the printheads to complete a forward scan.

16. The printhead of claim 9, wherein all visible printing fluids are dispensed during forward scans and all colorless printing fluids are dispensed during reverse scans.

17. A printer comprising a common scan axis to mount a first fluid printhead and a second fluid printhead, the common scan axis being substantially perpendicular to a media advance direction, wherein the first fluid printhead and the second fluid printhead are moveable along the common scan axis and along an axis parallel to the media advance direction, the first and second printhead being shifted along the media advance direction between each traverse of the media, the first printhead comprising a visible printing fluid and the second printhead comprising a pretreatment or posttreatment printing fluid, the first printhead firing when the printheads scan in one direction and the second printhead firing when the printheads scan in the opposite direction.

18. The printer of claim 17 wherein the second printing fluid is a fixer fluid.

19. The printer of claim 17, wherein the second printing fluid is a binder fluid.

20. The printer of claim 17, wherein the first printhead comprises a plurality of printheads depositing different color printing fluids.

* * * * *